US006142353A

United States Patent [19]

Boss et al.

[11] Patent Number: 6,142,353

[45] Date of Patent: Nov. 7, 2000

[54] STAPLING ARRANGEMENT FOR A GATHERING AND STAPLING MACHINE HAVING A GATHERING CHAIN

[75] Inventors: Heinz Boss, Strengelbach; Beat von Aesch, Schönenwerd, both of Switzerland

[73] Assignee: Graph-Holding AG, Hergiswil, Switzerland

[21] Appl. No.: 09/313,647

[22] Filed: May 18, 1999

[30] Foreign Application Priority Data

May 18, 1998 [EP] European Pat. Off. ..... 98810456

[51] Int. Cl.[7] ..... B42B 2/00

[52] U.S. Cl. ..... 227/44; 227/81; 227/82; 227/100; 227/155; 270/37; 270/52.16; 270/52.18

[58] Field of Search ..... 227/81, 100, 78, 227/82, 83, 88, 89, 155, 79, 44; 270/52.16, 52.18, 52.28, 52.26, 52.27, 52.29

[56] References Cited

U.S. PATENT DOCUMENTS 4,614,290 9/1986 Boss ..... 227/81
5,120,036 6/1992 Simons ..... 270/52.18
5,356,125 10/1994 Hansch et al. ..... 227/82
5,417,410 5/1995 Meier ..... 270/52.18
5,667,212 9/1997 Merkli ..... 270/52.16

*Primary Examiner*—Scott A. Smith
*Attorney, Agent, or Firm*—Venable; Robert Kinberg

[57] ABSTRACT

A stapling arrangement of a stapling and gathering machine includes a stapling carriage which is seated on a machine frame and travels with a gathering chain for stapling printed products carried by the gathering chain. At least one stapling head travels with the stapling carriage and with a bending device. A drive mechanism is provided for the stroke of the stapling carriage and the strokes of a shaping element and a punch of the stapling head. The drive mechanism includes a first drive for the stroke of the stapling carriage, and a second drive for the strokes of the shaping element and the punch, and for a movement of the bending device. The first drive can be exchanged independently of the second drive for adaptation to the pitch of the gathering chain. The stapling arrangement can also be converted quickly and easily to a different chain pitch by a semi-skilled operator. The bending device is supported such that it can yield downward when the products to be stapled vary in thickness, or when an overload occurs due to a paper jam. The bending device is preferably supported by springs.

14 Claims, 5 Drawing Sheets

STAPLING ARRANGEMENT FOR A GATHERING AND STAPLING MACHINE HAVING A GATHERING CHAIN

CROSS-REFERENCE TO RELATED APPLICATIONS

Priority is claimed herein with respect to Application No. 98810456.8 filed in the European Patent Office on May 18, 1998, the disclosure of which is incorporated herein by reference.

BACKGROUND OF THE INVENTION

The invention relates to a stapling (stitching) arrangement for a gathering and stapling machine, comprising: a machine frame; a circulating gathering chain for transporting printed products; a stapling carriage mounted on the machine frame for traveling with the gathering chain for stapling the printed products; at least one stapling head mounted for traveling with the stapling carriage and including a shaping element for shaping staples from a wire and a punch for punching the staples into the printed products; a bending device including a displaceable bending element for bending the staples when the staples are punched through the printed products; and drive means for the stapling carriage, the bending element and the punch.

Stapling machines of this type have traveling stapling heads, and permit the continuous stapling of products. The products therefore need not stop in order to be stapled, then accelerated. Stapling machines of this type are known in practice, and permit a comparatively high production speed. This kind of stapling machine is disclosed, for example, in the Applicant's Swiss patent publication CH-A-662 987.

These stapling machines are, however, designed for a fixed chain pitch of 21 inches, or 14/15 inches. The disadvantages of this are as follows: In the use of, for example, a gathering and stapling machine having a chain pitch of 21 inches products in a DIN format range of A5 through A3 and so-called double-sided products can be processed. For products of A4 format, however, the machine only operates with an output of 14,000 to 15,000 copies per hour. With a gathering and stapling machine having a chain pitch of 15 inches, products of A4 format can be processed with a significantly higher output of 18,000 copies per hour.

Products of A3 format or so-called double-sided products, however, cannot be processed in a machine having a chain pitch of 15 inches. A gathering and stapling machine having a variable chain pitch would therefore be desirable. As already mentioned, the known stapling machines having traveling stapling heads are limited to a fixed chain pitch, and cannot be converted.

SUMMARY OF THE INVENTION

It is an object of the invention to provide a stapling machine of the type mentioned at the outset, which can be simply adapted to different chain pitches.

The above and other obj ects are accomplished in accordance with the invention by the provision of a stapling arrangement for a gathering and stapling machine, comprising: a machine frame; a circulating gathering chain for transporting printed products; a stapling carriage mounted on the machine frame for traveling with the gathering chain during stapling of the printed products; at least one stapling head mounted for traveling with the stapling carriage and including a shaping element for shaping staples from a wire and a punch for punching the staples into the printed products; a bending device including a displaceable bending element for bending the staples when the staples are punched through the printed products; and drive means for the stapling carriage, the shaping element and the punch, wherein the drive means includes a first drive for a stroke of the stapling carriage, and a second drive for strokes of the shaping element and of the punch, and a movement of the bending element of the bending device, the first drive being converted for adaptation to a pitch of the gathering chain independently of the second drive.

In the stapling machine of the invention, a drive is provided for the stroke of the stapling carriage, and a separate drive is provided for the strokes of the shaping element and the punch. The two drives can be converted independently of one another. To convert the stapling-carriage stroke from, for example, about 140 mm for a chain pitch of 14 inches to about 200 mm for a 21-inch chain pitch, only the drive for the stapling-carriage stroke need be convened. The drive for the strokes of the shaping element and the punch is Therefore not affected. The conversion is therefore structurally considerably simpler, and can also be performed by a semi-skilled operator. Another significant point is that the punch and the shaping element are driven independently of the stapling carriage stroke. The movements of the punch and the shaping element can therefore be matched simply and optimally to the stapling-head functions.

Further advantageous features ensue from the following description considered in conjunction with the accompanying drawings.

BRIEF DESCRIPTION OF THE DRAWINGS

An embodiment of the invention is explained in detail below in conjunction with the drawings.

DETAILED DESCRIPTION OF THE INVENTION

Figure 1:
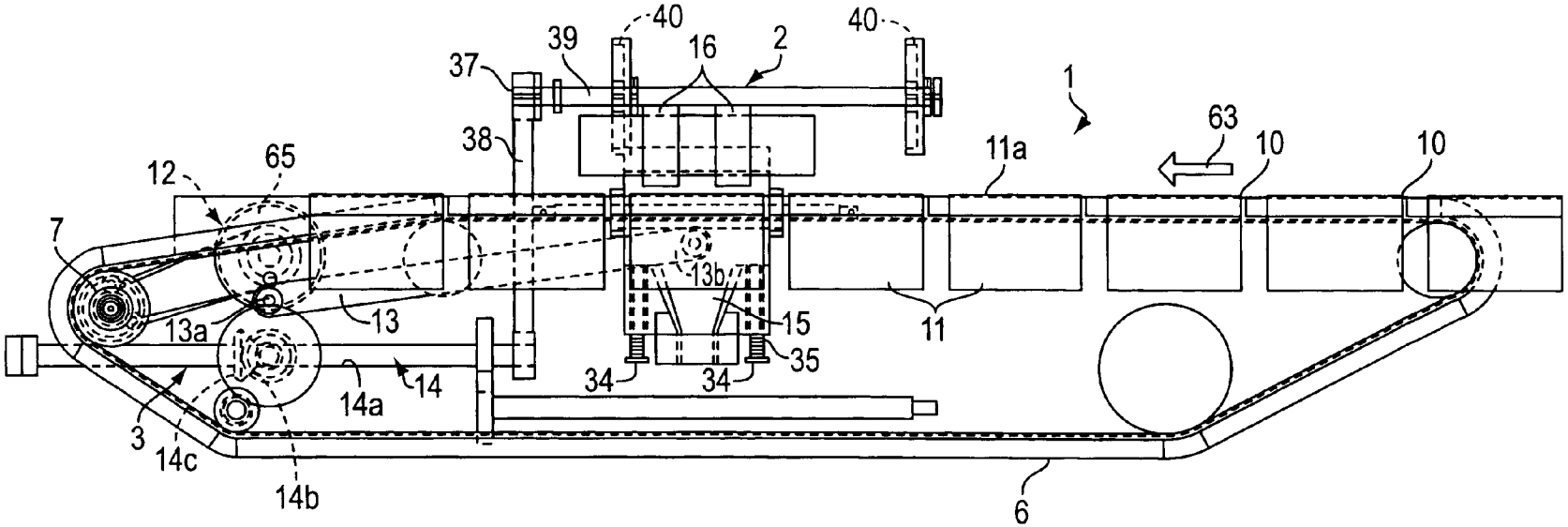
FIG. 1 shows a side view of a gathering and stapling machine having a stapling arrangement that is only shown schematically and not in its entirety.
Figure 5:
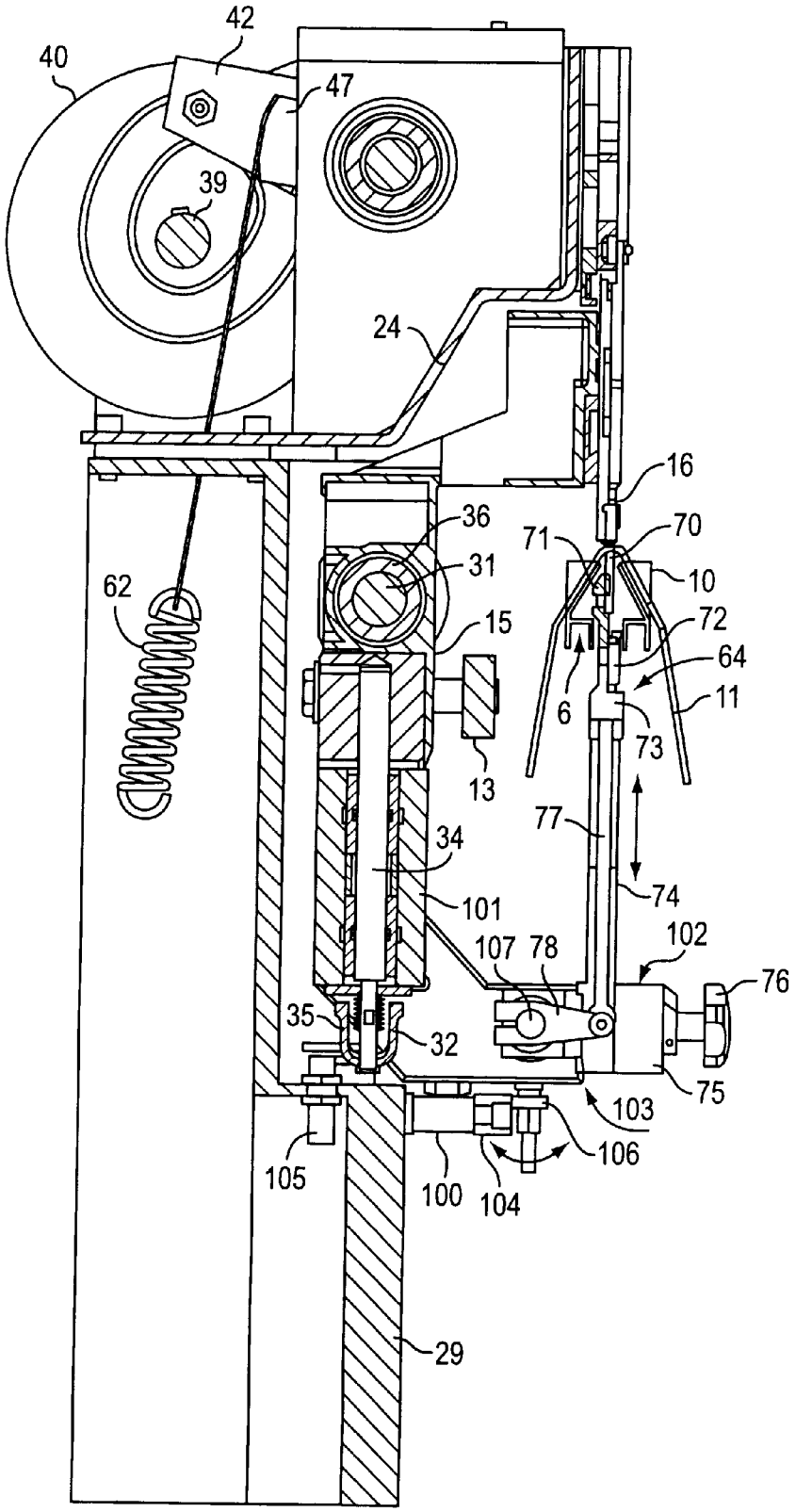
FIG. 5 shows a section along the line V—V of FIG. 2.

Referring to FIG. 1, there is shown a gathering and stapling machine 1 having a stapling arrangement 2 and a drive 3. A double gathering chain 6 is provided for transporting products 11 to be processed. Double gathering chain 6 possesses carriers 10, which are spaced corresponding to a chain pitch. In a region of its upper fold 11*a*, the rear side of a product 11 rests against these carriers. Products 11 are, for example, magazines, brochures or other printed products. These products straddle double gathering chain 6. Double gathering chain 6 is driven by drive 3 via a chain wheel 7. The double gathering chain, which is known per se, permits the stapling of printed products 11 at fold 11*a*. For this purpose, stapling arrangement 2 includes a stapling carriage 15 having a bending device 64, which is known per se and is shown in FIG. 5, and extends from below into double gathering chain 6 such that, for stapling a product 11, the product can be brought to rest with its fold 11*a* against a bending element 70 to transmit the bending-element stroke. Bending element 70 cooperates with stapling heads 16, which are disposed above bending element 70 and can move from above toward product 11 and bending element 70 with a working stroke and a return stroke. The illustrated stapling arrangement 2 has two spaced stapling heads 16. Stapling arrangement 2 can, however, have more or fewer stapling heads 16. In FIG. 5, stapling heads 16 are in an operating position.

Once products 11 are stapled, they are individually grasped by a delivery device, not shown, and raised from running double gathering chain 6, then supplied to, for example, a cutting device, not shown, for further processing. A person of skill in the art is familiar with different embodiments of such delivery devices.

Stapling carriage 15 having two stapling heads 16 travels with the continuously-conveyed products 11 during a stapling process. Products 11 are thus not stopped for stapling, and need not be accelerated afterward. During stapling of products 11, stapling carriage 15 performs a stroke in the direction of arrow 63 (FIG. 1) with stapling heads 16, which travel with it. Following stapling, a corresponding stroke is performed in the opposite direction. To this end, a first drive 12 is provided, which has a crank wheel 65, to which a crank 13 is hinged. The connection of crank 13 to crank wheel 65 is effected with an eccentrically-seated journal 13*a*. Through the rotation of journal 13*a*, the stroke of the stapling carriage can be converted from, for example, 140 mm for a chain pitch of 14 inches to a stroke of 200 mm for a 21-inch chain pitch. For other strokes, bores, which are not shown here, can be provided in crank wheel 65. Drive 12 is disposed outside of an oil-lubricated gear case, not shown here. Consequently, oil losses along the connecting rod can be avoided, and no paper dust can infiltrate the gear of drive 12. Crank 13 is hinged to the stapling carriage 15 by an upper end 13*b*.

Figure 2:
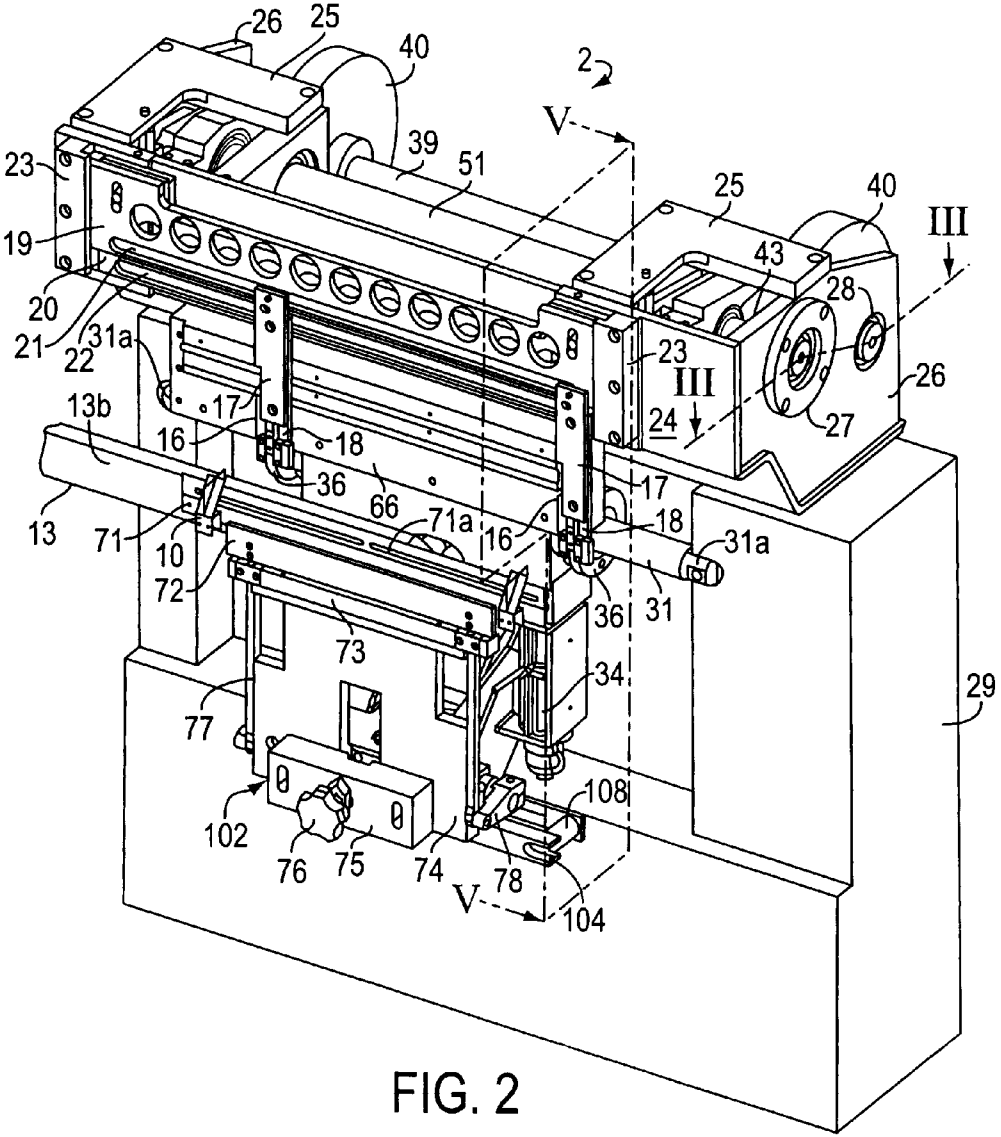
FIG. 2 shows a perspective view of a stapling arrangement according to the invention.

FIG. 2 only shows upper end 13*b* of connecting rod 13 of first drive 12. A guide rod 31, which is fixedly connected by its two ends 31a to machine frame 29, is provided for guiding stapling carriage 15. For the seating of carriage 15 on guide rod 31, the carriage has a sliding guide with two spherical liners 36. The two stapling heads 16 are fixedly connected to the guide by way of a displaceable retaining plate 66. Stapling heads 16 are displaceably secured to retaining plate 66.

According to FIG. 5, stapling carriage 15, which is guided to be horizontally displaced to a limited extent by guide rod 31 and the two spherical liners 36, is supported at its lower end by a roller 100 at machine frame 29. A bending element support 101 is secured to stapling carriage by way of two vertical guide rods 34. A nut 32 that is adjustable in height is mounted to the lower end of each guide rod 34, and supports a biased compression spring 35. The upper ends of the two compression springs 35 respectively load bending element support 101, which can yield downward in the event of thickness variations due to selective binding, or if an overload occurs due to a paper jam. If a predetermined path is exceeded, an inductive switch 105 secured to machine frame 29 shuts off the machine.

Bending element carrier 102 can be set to the product thickness with a hand wheel 76 and an eccentric, not shown here. In so-called selective binding, printed products 11 of varying thicknesses are stapled in the same production. Hand wheel 76 is used to adjust bending elements 64 in height to the thinnest printed product 11, which achieves a constant stapling quality. The thicker the printed product 11, the larger the path by which bending element support 101 yields downward under the counter-force of springs 35. As is apparent, the height adjustment of bending elements 64 is not affected during the adjustment of nut 32.

Bending elements 70 are laterally displaceable on a bending element strip 73, and are thus oriented to stapling heads 16. A bending element rod assembly 103 is seated on a bending element carrier 102. This assembly is adjusted in height with bending element carrier 102. Bending element rod assembly 103 is actuated by the carrier stroke by way of a tab 104 that has a curved cutout and is secured to the machine frame 29 with connectors 108, and a pivotable cam roller 106. The bending-element stroke is therefore independent of the thickness setting of the bending element carrier 102.

For the lateral orientation of bending elements 70 to stapling heads 16, in accordance with FIG. 2, a horizontally-extending carrier 71 is provided with guide slots 71*a*. Bending element 70 is omitted here for a better overview. A crossbeam 72, which likewise extends horizontally, serves to transmit the bending-element stroke to bending element 70. Bending-element carrier 102 is displaceable in height between bending element 70 and stapling head 16 for setting the product thickness, and has a plate-shaped part 74 and a part 75 that is fixedly connected to part 74 and receives hand wheel 76. For adjusting the thickness, hand wheel 76 is provided with an eccentric, not shown here. In accordance with FIG. 5, bending-element rod assembly 103 has two rods 77 that are respectively hinged to a lever 78. The motion of the aforementioned cam roller 106 is transmitted to the levers 78 by way of a shaft 107 vertical guided, to which the levers 78 are clamped.

In a known manner, the two stapling heads 16 each have a punch 17 and a shaping element 18. For stapling, punch 17 and the shaping element 18 respectively perform a working stroke and a return stroke. The staples to be punched in are cut from a coil of wire, not shown. The stapling process is familiar to a person of skill in the art, and therefore need not be explained here.

Figures 3A, 3B:
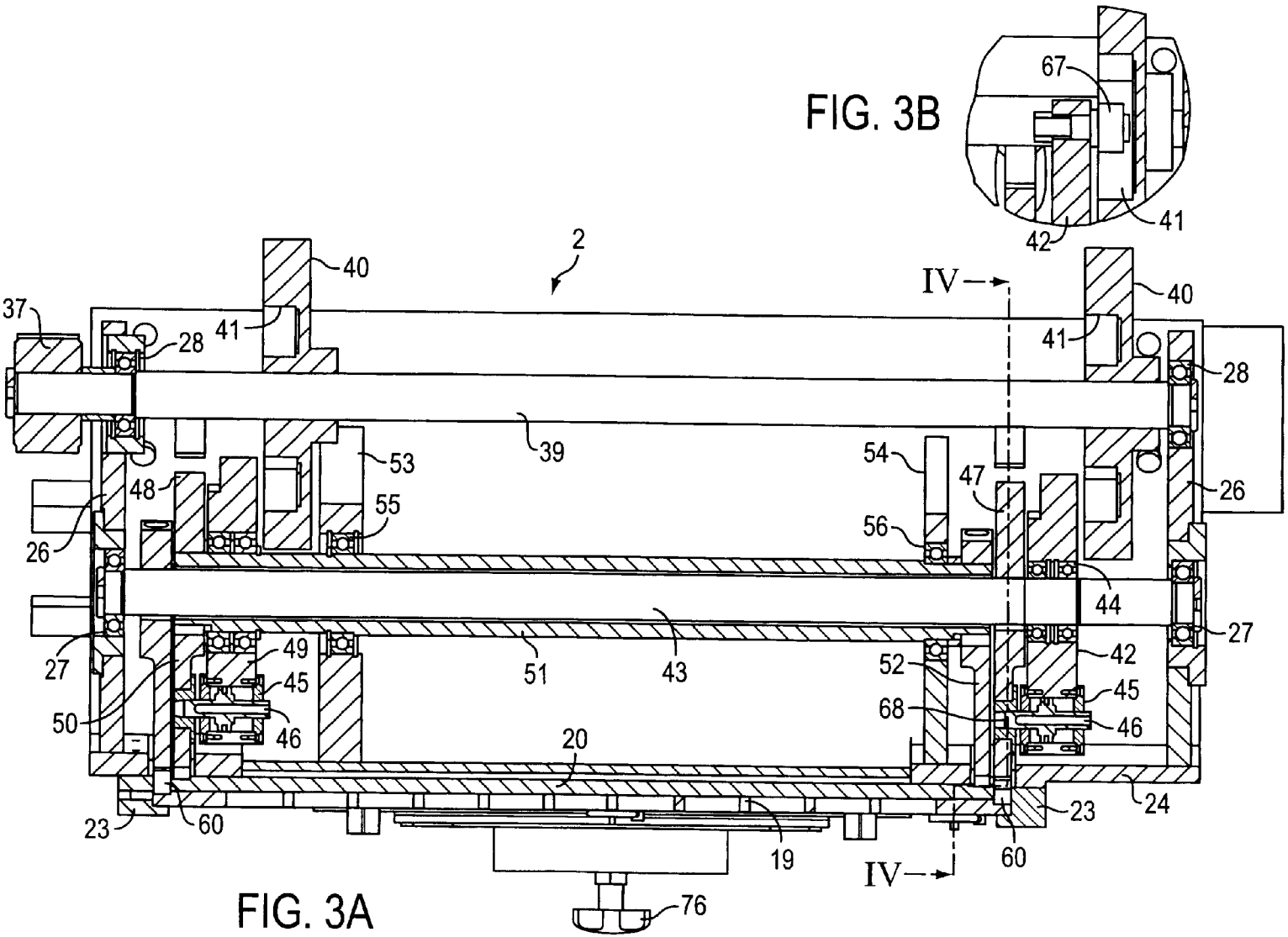
FIG. 3*a* shows a section along the line III—III of FIG. 2.
FIG. 3*b* shows a partial view of the section according to FIG. 3*a*.
Figure 4:
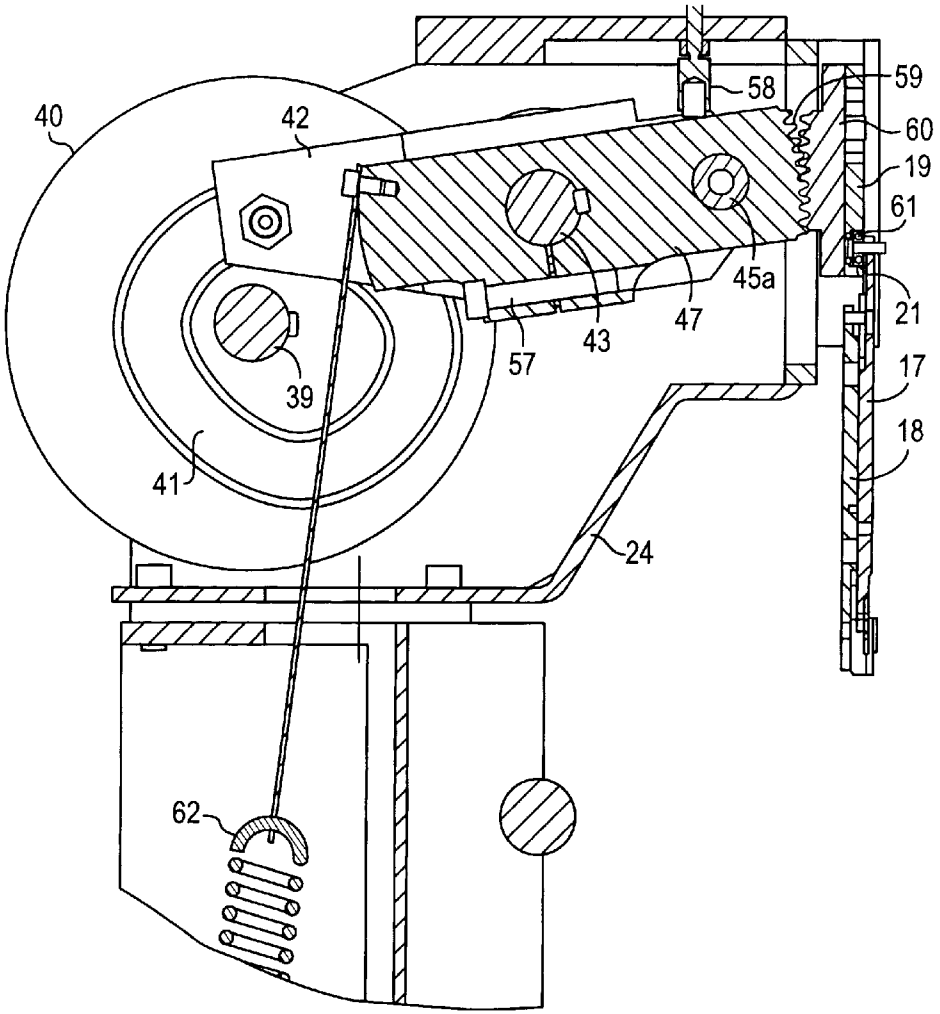
FIG. 4 shows a section along the line IV—IV of FIG. 3*a*.

For the working and return strokes, punches 17 are seated in a guide slot 21 of a punch sliding member 19. Shaping elements 18 are moved by a cam roller that extends into a guide slot 22 of a shaping-element sliding member 20. The ends of the two sliding members 19 and 20 are seated on a retaining plate 24 to be vertically displaced by means of two guide tabs 23. The rear sides of the upper ends of the two punches 17 are respectively provided with a roller 61, which extends into guide slot 21 (FIG. 4). The bending elements 18 are likewise each provided with a roller, not shown, that extends into guide slot 22. During the stroke movements of the carriage 15, the two stapling heads can be guided in guide slots 21 and 22 to be displaced relative to the two sliding members 19 and 20. At the same time, punches 17 and shaping elements 18 can perform their working and return strokes through vertical movements of guided sliding members 19 and 20. A second drive 14, which, according to FIG. 1, has a shaft 14*a* that is connected to a drive wheel 14*c* via a bevel wheel 14*b*, is provided for these movements of sliding members 19 and 20. Drive wheel 14*c* is likewise connected to the main drive shaft, not shown. The rotational movement of shaft 14*a* is transmitted to a drive shaft 39 with a toothed belt 38 and a drive wheel 37. According to FIG. 2, drive shaft 39 is seated with bearings 28 on two bearing plates 26. Bearing plates 26 are connected to two retaining plates 25. As shown in FIGS. 3*a* and 4, two cam disks 40, each having a curved groove 41, are secured with spacing to drive shaft 39.

A further shaft 43, which extends coaxially through a hollow shaft 51 that is rotatably seated with pivot bearings 55 and 56 on two further bearing plates 53 and 54, is seated with pivot bearings 27 on bearing plates 26, parallel to and with spacing from drive shaft 39. Two punch levers 47 and 48 are secured, fixed against relative rotation, to shaft 43. Furthermore, a cam lever 42 is rotatably seated with a bearing 44 on shaft 43. As shown in FIG. 3*b*, a roller 67, which extends into the curved groove 41, is mounted to crank cam lever 42. When the cam disk 40 rotates, cam lever 42 is pivoted about shaft 43 corresponding to the course of the curved groove 41. Mounted to the two-armed cam lever 42, opposite roller 67, is a pneumatically-actuatable coupling 45, which extends with a coupling pin 46 into a conical bore 68 of punch lever 47. As shown in FIG. 3*a*, the coupling pin 46 forms a plunger, and can be moved to the right by way of a pneumatic line, not shown here, thereby releasing the coupling. In the illustrated coupled state, punch lever 47 is pivoted in a form-fit with crank lever 42. Because punch lever 47 is now connected, fixed against relative rotation, to shaft 43, further punch lever 48 is simultaneously pivoted in the same direction.

As shown in FIG. 4, punch lever 47 has a toothing 59, which meshes with a toothing of a rack 60. The rear side of rack 60 is fixedly connected to punch sliding member 19. Punch lever 48 engages a further rack 60 in the same manner. When shaft 43 rotates, the two punch levers 47, 48 compel sliding member 19 to move vertically. Curved groove 41 is now embodied such that punch sliding member 19 comes to a standstill for a specific time in an upper reversal point. During this standstill, coupling 45 can be pneumatically actuated.

Shaping-element sliding member 20 is moved vertically, similarly to punch sliding member 19. For this purpose, cam lever 49, which is rotatably seated on hollow shaft 51, is moved in accordance with FIG. 3*a*, and transmits this pivoting movement to a shaping-element lever 50. Shaping-element lever 50 is connected, fixed against relative rotation, to hollow shaft 51. Through the meshing of teeth, the two bending-element levers 50 and 52 engage the bending-element sliding member 20 in the same manner as the punch levers 47 and 48. When the hollow shaft 51 rotates, shaping-element sliding member 20 is correspondingly moved vertically. Shaping-element sliding member 20 is also controlled such that it comes to a standstill for a specific period in an upper reversal point, in which coupling 45 can be pneumatically actuated. According to FIG. 4, a tension spring 62 is provided, which acts on punch lever 47. In the uncoupled state, tension spring 62 draws punch lever 47 toward a stop 58 in the upper reversal point. A further tension spring, not shown, is provided for shaping-element lever 50.

The vertical movements of punch sliding member 19 and shaping-element sliding member 20 are forced to be transmitted to punches 17 and shaping elements 18. The working stroke serves to shape and punch in the staples, and the return stroke serves to advance and trim the staple wire. These movements constitute the working and return strokes, and are performed in the same manner in each position of stapling heads 16. The stapling process can therefore be performed as the two stapling heads 16 travel. A critical point is that drive 14 for the working and return strokes of punches 17 and shaping elements 18 be adjustable independently of the drive 12. Crank 13 can therefore be converted without an adjustment of the stapling mechanism of the two stapling heads 16, and vice versa: the stapling mechanism can be adjusted without affecting the stroke movement of carriage 15. Another crucial point is that stapling heads 16 can also be used for stapling thick and hard products. It is also easily possible to replace cam wheels 40 with wheels having a different curved groove for adapting the corresponding vertical movements of punches 17 and shaping elements 18 to especially thick and voluminous products 11. This process does not affect the horizontal stroke of stapling carriage 15.

The invention has been described in detail with respect to referred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A stapling arrangement for a gathering and stapling machine, comprising a machine frame;

a circulating gathering chain for transporting printed products;

a stapling carriage mounted on the machine frame for traveling with the gathering chain during stapling of the printed products;

at least one stapling head mounted for traveling with the stapling carriage and including a shaping element for shaping staples and a punch for punching the staples into the printed products;

a bending device including a displaceable bending element for bending the staples when the staples are punched through the printed products; and drive means for the stapling carriage, the bending element and the punch, wherein the drive means includes a first drive for a stroke of the stapling carriage, and a second drive for strokes of the shaping element and of the punch, and a movement of the bending element of the bending device, the first drive being exchangeable independently of the second drive for adaptation to a pitch of the gathering chain.

2. The machine according to claim 1, and further include cam mechanisms for moving the punch and the shaping element independently of the stroke of the stapling carriage.

3. The machine according to claim 2, wherein the cam mechanisms are closed.

4. The machine according to claim 1, and further including sliding members along which the punch and the shaping element are respectively mounted and guided for horizontal displacement; wherein the second drive is coupled to the sliding members for moving the sliding members vertically for performing the shaping and punch strokes, and the second drive is adapted for causing the sliding members to come to a standstill for a time in an upper reversal point at which a coupling can be selectively actuated.

5. The machine according to claim 1, wherein the second drive includes pneumatically-actuated couplings.

6. The machine according to claim 5, wherein the second drive includes a pivoting lever connected to each sliding member and a cam lever operatively arranged with each pivoting lever, each cam lever mounting one of the pneumatically-actuated couplings, and each pneumatically-actuated coupling form-fittingly transmits a pivoting movement of the cam lever to the respective pivoting lever for vertically moving the respective sliding member.

7. The machine according to claim 6, wherein each sliding member includes a rack for guidance and each pivoting lever includes a tooth segment for engaging the rack.

8. The machine according to claim 7, wherein each sliding member includes two racks spaced apart from one another.

9. The machine according to claim 8, and further including two shafts, wherein the pivoting levers include two spaced apart pivoting levers connected to one shaft for engaging a respective one of the racks of one sliding member and two pivoting levers connected to the other shaft for engaging a respective one of the racks of the other sliding member.

10. The machine according to claim 9, wherein one of the two shafts is a hollow shaft and is coaxially penetrated by the other shaft.

11. The machine according to claim 1, and further including a spring supporting the bending device.

12. The machine according to claim 11, and further including means for adjusting the bending device in height and for setting the bending device for varying thicknesses of the products to be stapled.

13. The machine according to claim 12, wherein the spring is arranged for securing the bending device against an overload and further including means for shutting off the machine if a specified path is exceeded.

14. The machine according to claim 13, and further including a cam roller, and a tab having a curved cutout and secured to the machine frame, the bending element of the bending device having a stroke that is actuated by the tab via the cam roller.

* * * * *

UNITED STATES PATENT AND TRADEMARK OFFICE

CERTIFICATE OF CORRECTION

PATENT NO. : 6,142,353
DATED : November 7, 2000
INVENTOR(S) : Boss et al.

It is certified that error appears in the above-identified patent and that said Letters Patent is hereby corrected as shown below:

Title page,
Item [73], change Item [73] to read -- Grapha-Holding AG, Hergiswil, SWITZERLAND --

Signed and Sealed this

Second Day of July, 2002

*Attest:*

*Attesting Officer*

JAMES E. ROGAN
*Director of the United States Patent and Trademark Office*